US008783770B2

(12) United States Patent
Tanaka et al.

(10) Patent No.: US 8,783,770 B2
(45) Date of Patent: Jul. 22, 2014

(54) CHAIR

(75) Inventors: Kouichi Tanaka, Oita (JP); Hiroki Denmyouji, Yamaguchi (JP); Kiyomi Matsuo, Saga (JP)

(73) Assignees: Beautiful Life Co., Ltd., Oita (JP); Saga University, Saga (JP)

( * ) Notice: Subject to any disclaimer, the term of this patent is extended or adjusted under 35 U.S.C. 154(b) by 413 days.

(21) Appl. No.: 13/129,897

(22) PCT Filed: Mar. 11, 2009

(86) PCT No.: PCT/JP2009/054626

§ 371 (c)(1),
(2), (4) Date: Jul. 19, 2011

(87) PCT Pub. No.: WO2010/061644

PCT Pub. Date: Jun. 3, 2010

(65) Prior Publication Data

US 2011/0266841 A1 Nov. 3, 2011

(30) Foreign Application Priority Data

Nov. 25, 2008 (JP) ..... 2008-299789

(51) Int. Cl.
*A61G 15/00* (2006.01)
*A47C 7/02* (2006.01)
*A47C 1/034* (2006.01)

(52) U.S. Cl.
CPC ..... *A47C 1/0342* (2013.01); *A47C 7/024* (2013.01)
USPC ..... 297/316; 297/284.3; 297/300.3; 297/90

(58) Field of Classification Search
USPC ..... 297/284.3, 320, 316, 300.3, 300.6, 297/423.17, 90, 284.1, 68
See application file for complete search history.

(56) References Cited

U.S. PATENT DOCUMENTS 2,764,224 A * 9/1956 Maurer ..... 297/87
2,843,183 A * 7/1958 Luckhardt ..... 297/61

(Continued)

FOREIGN PATENT DOCUMENTS

JP 2000-152840 6/2000
JP 2001-149413 6/2001

(Continued)

OTHER PUBLICATIONS

International Search Report issued Jun. 23, 2009 in corresponding International Application No. PCT/JP2009/054626.

*Primary Examiner* — David E Allred
(74) *Attorney, Agent, or Firm* — Wenderoth, Lind & Ponack, L.L.P.

(57) ABSTRACT

A chair includes: a backrest with a waist support projecting part; a horizontal forward seat; a backward seat pivotally supported so as to be able to swing downward relative to the forward seat; a leg support pivotally supported at a front end of the forward seat; links for changing a positional relation between the rear end of the backward seat and the lower end of the backrest so that a distance from the waist support projecting part to the backward seat is reduced from a standing posture to a tilted posture as the backrest is tilted backward; and a connection link for connecting the lower end of the backrest and a part of the leg support lower than the upper end of the leg support so as to cause the leg support to swing forward as the backrest is tilted backward.

5 Claims, 6 Drawing Sheets

(56) References Cited

U.S. PATENT DOCUMENTS

| | | | | |
|---|---|---|---|---|
| 3,863,984 | A * | 2/1975 | Sickels | 297/423.17 |
| 4,300,249 | A * | 11/1981 | Taylor | 4/661 |
| 4,456,297 | A * | 6/1984 | Pietschmann et al. | 297/316 |
| 4,596,421 | A * | 6/1986 | Schmitz | 297/316 |
| 4,637,652 | A * | 1/1987 | Bergenwall | 297/90 |
| 5,423,594 | A * | 6/1995 | Hancock et al. | 297/300.2 |
| 6,155,645 | A * | 12/2000 | Bedrich | 297/423.28 |
| 6,431,649 | B1 * | 8/2002 | Hensel | 297/300.2 |
| 6,523,898 | B1 * | 2/2003 | Ball et al. | 297/320 |
| 6,572,190 | B2 * | 6/2003 | Koepke et al. | 297/284.1 |
| 7,066,537 | B2 * | 6/2006 | Coffield et al. | 297/284.4 |
| 7,338,133 | B2 * | 3/2008 | Laffin | 297/466 |
| 8,419,133 | B2 * | 4/2013 | Holt et al. | 297/354.11 |
| 8,469,454 | B2 * | 6/2013 | Holt et al. | 297/452.63 |
| 2002/0190552 | A1 * | 12/2002 | Koepke et al. | 297/284.7 |
| 2004/0046432 | A1 * | 3/2004 | Ball et al. | 297/284.4 |
| 2007/0069563 | A1 * | 3/2007 | Herzog | 297/284.3 |
| 2008/0217977 | A1 * | 9/2008 | Aldrich et al. | 297/284.3 |
| 2009/0021063 | A1 * | 1/2009 | Morita et al. | 297/319 |
| 2011/0193387 | A1 * | 8/2011 | Kim | 297/316 |
| 2011/0248537 | A1 * | 10/2011 | Aldrich et al. | 297/284.3 |
| 2012/0001465 | A1 * | 1/2012 | Rinne et al. | 297/284.3 |

FOREIGN PATENT DOCUMENTS

| | | |
|---|---|---|
| JP | 2004-141247 | 5/2004 |
| JP | 2008-212399 | 9/2008 |

* cited by examiner

CHAIR

TECHNICAL FIELD

The present invention relates to a chair. To be more specific, the present invention concerns a chair suitably used for facilities supplying services (a shampoo, a cut, diagnosing, treatment, or the like.) by hairdressers/barbers, dental clinics, otolaryngology clinics, or the like.

BACKGROUND ART

Conventionally, there are practically used chairs provided with reclining functions for tilting backrests backward so that seated persons can take tilted postures and/or lying postures.

FIG. 6(*a*) and FIG. 6(*b*) show side views of a conventional chair. The chair is provided with: a horizontal seat 100; a standing backrest 101; and a shaft 103 that pivotally and swingably supports the seat 100 and the backrest 101.

On the other hand, when taking the chair, a seating person puts his/her thighs 103 and waist 106 on the seat 100, and learns his/her body 108 against the backrest 101. As a result, lower legs 104 hang down from the front of the thighs 103 centering on knees 105, and the waist 106 is located near the shaft 103.

In the example of FIG. 6(*a*), a head 109 is located in a position slightly higher than the backrest 101. The fulcrums of the thighs 107 are greater trochanters 107 located at positions separated from the shaft 103.

When the seated person or his/her nursing attendant reclines the backrest 101 from the standing posture as shown in FIG. 6(*a*), the backrest 101 changes its posture into the tilted posture as shown in FIG. 6(*b*). Herein, since the greater trochanters 107 are separated from the shaft 103, the upper body, including his/her head 109, of the seated person slips downward. Such a slip is uncomfortable and may give the seated person anxiety when the seated person needs a nursing care or is corporally and/or mentally weak such as an aged person, a disabled person, and a hospitalized person or the like.

Especially as shown in FIG. 7(*a*), when the seated person sits shallowly, this slip becomes larger as shown in FIG. 7(*b*). When there is a skin trouble (for example, a bed sore, a burn injury, an inflammation, or the like) on the back of the seated person or near his/her waist 106, the slip gives the seated person aches and pains.

For example, when services of a shampoo are going to be supplied to the seated person by a hairdresser/barber, the entirety of the chair must be inclined downward rather than the tilted postures of FIG. 6(*b*) and FIG. 7(*b*) to arrange his/her head 109 backward on a shampoo bowl.

In such a case, the slip gives the seated person discomfort and/or anxiety. Furthermore, a nurse or the hairdresser/barber must support the body of the seated person with hands, and must move his/her head to reach on the shampoo bowl when the seated person is not a healthy person. Such work is very hard. The hairdresser/barber cannot begin his/her services immediately, thereby increasing waste of time.

When the head of the seated person is going to reach on the shampoo bowl, a situation changes from those of FIG. 8(*a*) and FIG. 8(*b*) to that of FIG. 8(*c*). The seated person may feel pain rather than discomfort since his/her legs are extraordinarily lifted up. This posture is very dangerous especially when the seated person has a hypertension, aftereffects of a stroke, or the like.

As shown in FIG. 9(*a*), Document 1 (Japanese Patent Application Laid-Open No. 2001-149413) discloses a technique of dividing a seat into a set of a forward seat part 110 and a backward seat part 111, and foldably connecting these seat parts 110 and 111 with a hinge 112. As shown in FIG. 9(*b*), this enables to fold the backward seat part 111 downward as the backrest 101 is gradually inclined backward, thereby slightly improving the problems caused by the above-mentioned slip.

As discussed above, when the backrest 101 is inclined greatly backward as shown in FIG. 9(*c*) like in a case where the hairdresser/barber is going to supply services of a shampoo to the seated person, the knees 105 are raised to form clearances from the thighs 103 and/or the lower legs 104 to the forward seat 110. Therefore, the lower body of the seated person becomes unstable to cause discomfort. Since the legs are extraordinarily lifted up as the same as FIG. 8(*c*), there is a danger as the almost same as that of FIG. 8(*c*).

[Document 1] Japanese Patent Application Laid-Open No. 2001-149413

[Document 2] Japanese Patent Application Laid-Open No. 2004-141247

SUMMARY OF INVENTION

Problem(s) to be Solved by Invention

In view of the above, an object according to the present invention is to provide a chair that can avoid a slip and an unnatural posture and that can safely and comfortably change a posture of a seated person from a standing posture to a tilted posture in one motion of inclining a backrest.

Means for Solving Problem(s)

A first aspect according to the present invention provides a chair, comprising: a backrest possessing a reference point; a seat including: a horizontal forward seat; and a backward seat continuously provided to the forward seat, the backward seat being pivotally supported so as to swing downward relative to the forward seat; a leg support possessing an upper end pivotally supported to a front end of the forward seat; a tilting mechanism for connecting a rear end of the backward seat and a lower end of the backrest so that the backrest is able to tilted backward from a standing posture to a tilted posture, the titling mechanism changing a positional relation between the rear end of the backward seat and the lower end of the backrest so that a distance from the reference point to the backward seat is reduced from the standing posture to the tilted posture as the backrest is tilted backward; and a connection mechanism for connecting the lower end of the backrest and a part of the leg support lower than the upper end of the leg support so as to cause the leg support to swing forward as the backrest is tilted backward.

According to this arrangement, the backrest is set up to the standing posture, and a seating person sits on the chair in a manner such that his/her waist contacts with the reference point. In this state, the distance between the reference point and the backward seat is the maximum, and the distance between his/her greater trochanters and the rear end of the backward seat is also the maximum.

When the backrest is tilted backward to take the tilted posture, his/her waist contacts with the reference point, thereby causing a slip on the backrest in general. The tilting mechanism, however, changes the positional relation between the rear end and the lower end of the backrest so that the distance between the reference point and the backrest is gradually reduced from the standing posture to the tilted posture. As a result, since the backrest follows motion of the upper body of the seated person, the seated person hardly feels the slip. Accordingly, anxiety and discomfort can be reduced. Since the backward seat swings downward relative to the forward seat to follow the posture change of the seated person moreover, the seated person can change his/her posture in comfort.

Providing with the connection mechanism to cause the leg support to swing forward enables to lift the leg support up, thereby keeping the leg support contacting with the lower legs of the seated person. With this arrangement, an unpleasant clearance below the knees of the seated person is hardly formed. The knees are never extraordinarily raised to be in danger. Accordingly, the seated person can change his/her posture in comfort.

A second aspect according to the present invention provides a chair as defined in the first aspect, further comprising a control unit for controlling a swing angle from the forward seat to the backward seat, wherein, while the swing angle is not controlled by the control unit, the tiling mechanism connects the rear end of the backward seat and the lower end of the backrest to keep the distance as the same as that of the standing posture so that the backrest and the backward seat swing integrally, and wherein, when the swing angle is controlled by the control unit, the tiling mechanism connects the rear end of the backward seat and the lower end of the backrest to reduce the distance from that of the standing posture so that the backrest and the backward seat swing independently from each other.

The control unit according to this arrangement can surely switch from a first state where the distance is unchanged from that of the standing posture to a second state where the distance is gradually reduced from that of the standing posture, or from the second state to the first state. Since the backrest swings independently of the backward seat in the second state where the distance is gradually reduced, the positions of the thighs are unchanged, and the seated person can change his/her posture in comfort.

A third aspect according to the present invention provides a chair as defined in the second aspect, wherein the control unit comprises a baffle board having an inclined plane abutting on a side face of the backward seat to control the swing angle.

This simple arrangement enables to surely control the swing angle.

A forth aspect according to the present invention provides a chair as defined in the first aspect, wherein the tilting mechanism comprises: a first link possessing a first end fastened by a hinge to the rear end of the backward seat, and a second end fastened by a hinge to a middle position between the lower end of the backrest and the reference point, respectively; and a second link formed longer than the first link, the second link possessing a third end fastened by a hinge to a position of the backward seat in front of the middle position, and a fourth end fastened by a hinge to the lower end of the backrest, respectively.

This simple arrangement enables to surely perform tilting operation. Herein, it is also thought to use a guide slit and a claw engaged there-with as the tilting mechanism. However, in this case, there may be a problem that the guide slot is covered with dust. This arrangement can prevent such a problem.

A fifth aspect according to the present invention provides a chair as defined in the first aspect, wherein a side support for a leg is added to a side of the leg support.

This arrangement enables to laterally support the lower legs of the seated person, thereby improving safety and comfort even when the legs of the seated person are weak.

A sixth aspect according to the present invention provides a chair as defined in the first aspect, wherein the backward seat is kept such that the backward seat is tilted downward at a small angle relative to the forward seat when the backrest is in the standing posture.

This arrangement enables the seated person to take a posture that his/her waist is lower than his/her thighs in the standing posture, thereby improving safety and comfort.

Effect of Invention

The present invention causes the motion of the backrest to follow the motion of the upper body of the seated person to reduce an unpleasant slip, thereby improving safety and comfort.

Not only the backward seat can swing downward relative to the forward seat but also the connection mechanism raises up the leg support to keep the state that the lower thighs contact there-with to avoid danger, thereby the seated person can change his/her posture in comfort.

BRIEF DESCRIPTION OF DRAWINGS

FIG. 6(*b*) is a side view of the conventional chair (half tilted posture);

FIG. 7(*b*) is a side view of the conventional chair (half tilted posture);

FIG. 8(*b*) is a side view of the conventional chair (half tilted posture);

FIG. 8(*c*) is a side view of the conventional chair (full tilted posture);

FIG. 9(*b*) is a side view of the conventional chair (half tilted posture); and FIG. 9(*c*) is a side view of the conventional chair (full tilted posture).

DETAILED DESCRIPTION OF THE INVENTION

Figure 1:
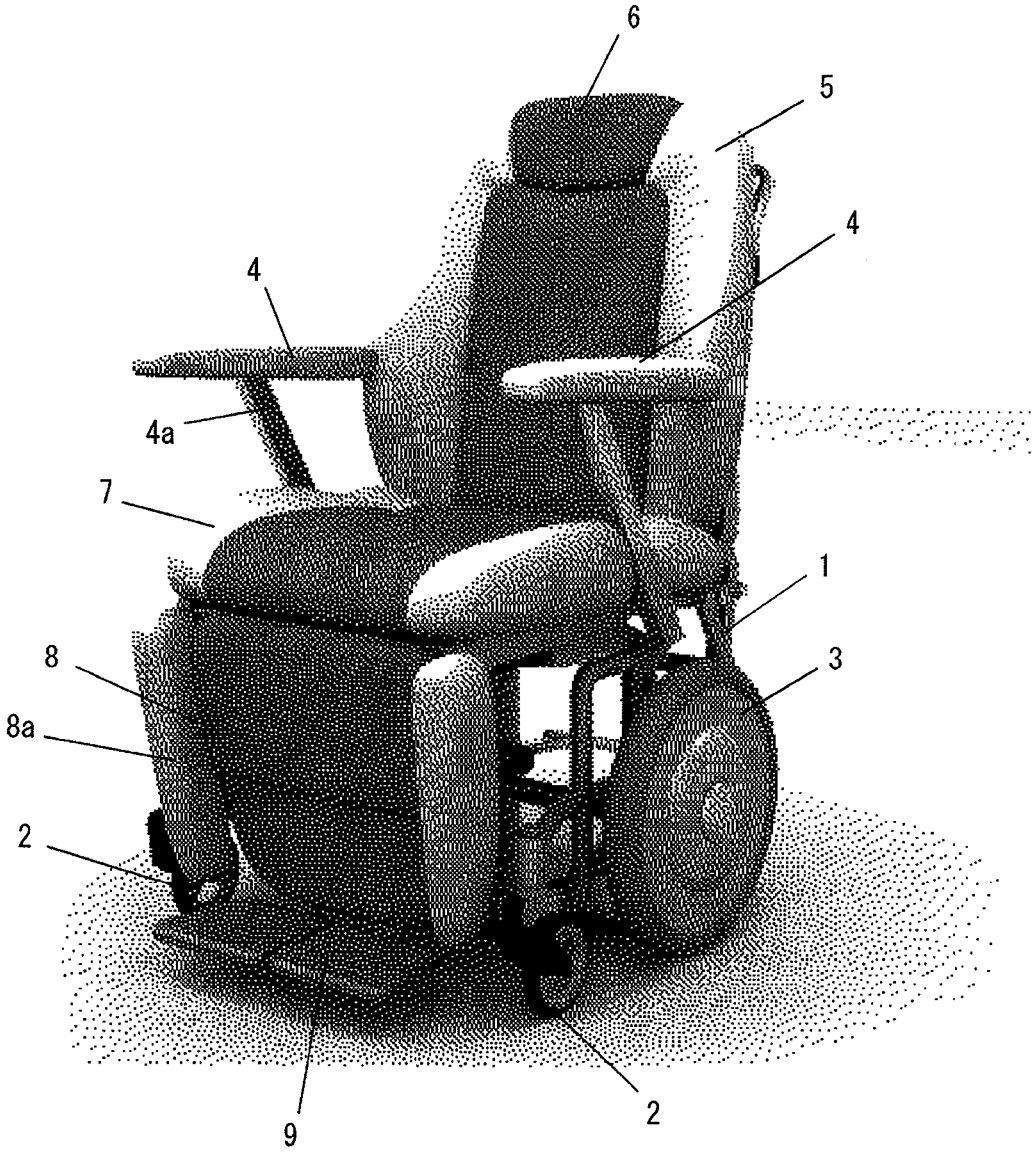
FIG. 1 is a perspective view of a chair (standing posture) in Embodiment 1 according to the present invention.
Figure 2:
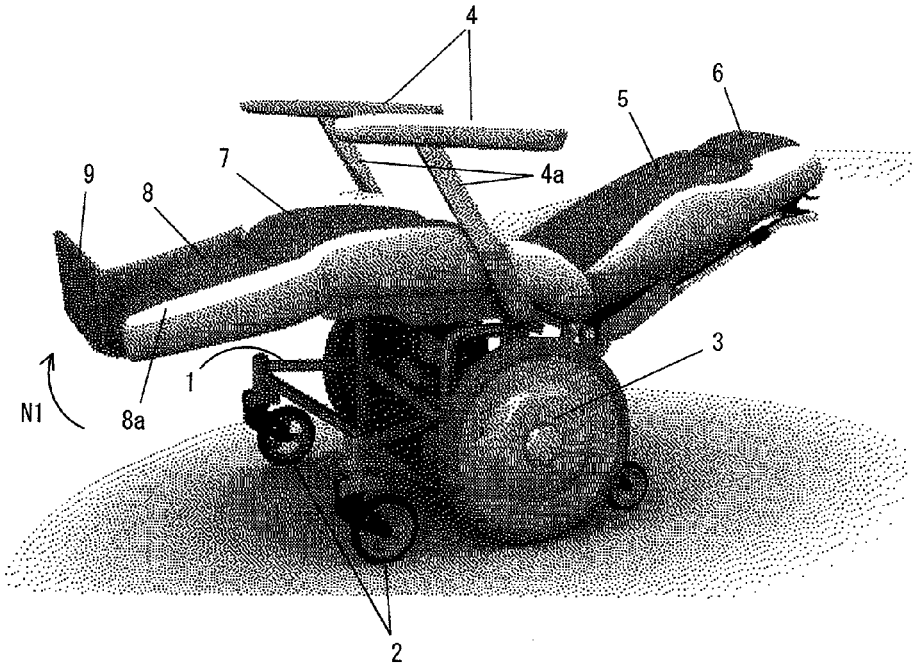
FIG. 2 is a perspective view of the chair (tilted posture) in Embodiment 1 according to the present invention.

Embodiments according to the present invention will now be described with reference to the accompanying drawings. FIG. 1 is a perspective view of a chair (in a standing posture) in Embodiment 1 according to the present invention, and FIG. 2 is a perspective view of the chair in a tilted posture.

As shown in FIG. 1, this chair includes a frame 1, and the other elements are provided movably/not movably relative to the frame 1. The chair shown in FIG. 1 is a chair designed in order that a hairdresser/barber can suitably supply services such as a shampoo, a cut, or the like to a seated person including one who needs a nursing care. For this reason, about four truckles 2 and about two wheels 3 are rotatably supported to the frame 1. In short, this chair is also a wheelchair.

As explained in full detail below, using this chair enables the reduction of a slip of the upper body when a backrest is tilted or when it is raised up. The chair is operable to reduce the slip so as to provide comfort to the seated person even when he/she is a healthy person, and it is preferably used in facilities (not only a hairdresser/barber but also a dental clinic, an otolaryngology clinic, or the like) where the seated person takes postures from a standing posture to the tilted posture. The chairs according to the present invention also include any chairs of such use. Since the slip can be reduced, regardless of the makeup of the seated person, he/she can comfortably change his/her posture even when he/she has low back pain.

Although the details of the mechanism will be mentioned later, this chair can take the standing posture shown in FIG. 1, the tilted posture shown in FIG. 2, and intermediate postures there-between. One pair of right/left horizontal armrests 4 are fixed on ends of arms 4*a* extending obliquely upward like cantilevers, and the seated person can put his/her left and right elbows on the armrests 4, respectively. The arms 4*a* are preferably constituted extentable in a step-less manner, and the heights of the armrests 4 are preferably adjusted according to the heights of the elbows of the seated person.

This chair includes: a seat 7; leg supports 8 extending downward from the forward end of the seat 7; and footrests 9 extending almost perpendicularly from the lower ends of the leg supports 8. Preferably, one pair of right/left side supports 8*a* are arranged on both sides of the leg supports 8. Preferably, the upper ends of the side supports 8*a* are pivotably supported by the leg supports 8 to enable middle and lower portions of the side supports 8*a* to tip up around the upper ends of the side supports 8*a*.

Due to this, the side supports 8*a* support the lower thighs of the seated person laterally, the side supports 8*a* play roles of additional bars, thereby keeping the lower thighs not sliding laterally out of the chair even when the lower legs of the seated person are weak. Thereby, safety and comfort of the chair can be improved.

Figure 3:
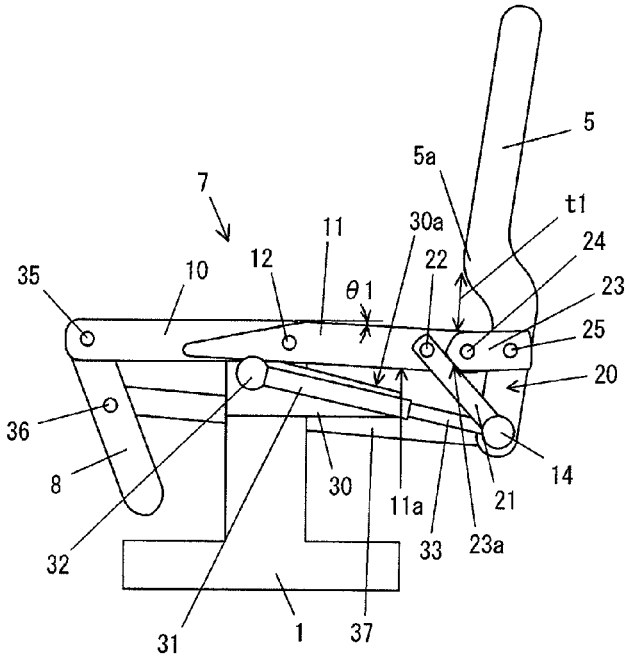
FIG. 3 is a side view of the chair (standing posture) in Embodiment 1 according to the present invention.

The backrest 5 is preferably formed to follow the backbone of the seated person so as to perform body pressure distribution. As shown in FIG. 3, a waist support 5*a* projecting forward is formed to the backrest 5 in accordance with the S-shape of the backbone of the seated person curving near his/her waist.

As shown in FIG. 1, a pillow 6 is detachably attached with the upper part of the backrest 5. Preferably, the height of the pillow 6 may be adjustable in a step-less manner according to the seated height of the seated person relative to the backrest 5. More preferably, various size and/or kinds of pillows may be selectably attached there-with according to a kind of services (for example, treatment or the like).

Preferably, the backrests 5 and the seats 7 may be formed detachably to enable to attach a selected one in accordance with the weight of the seated person.

Although not shown in the drawings, preferably, a handle device for pushing/pulling the entirety of the chair to move may be provided with the back of the backrest 5. Furthermore, preferably, the height of the handle device may be adjustable according to the height of the seated person.

Although not shown in the drawings, preferably, a lifting mechanism possessing a foot-operated lever may be provided with the chair. The lifting mechanism is operated with the lever so as to set up the height of the chair suitably for services to be supplied, to avoid low back pain of a service supplier, and to set up the height of the chair suitably for when the seated person stands up or sits down.

Figure 4:
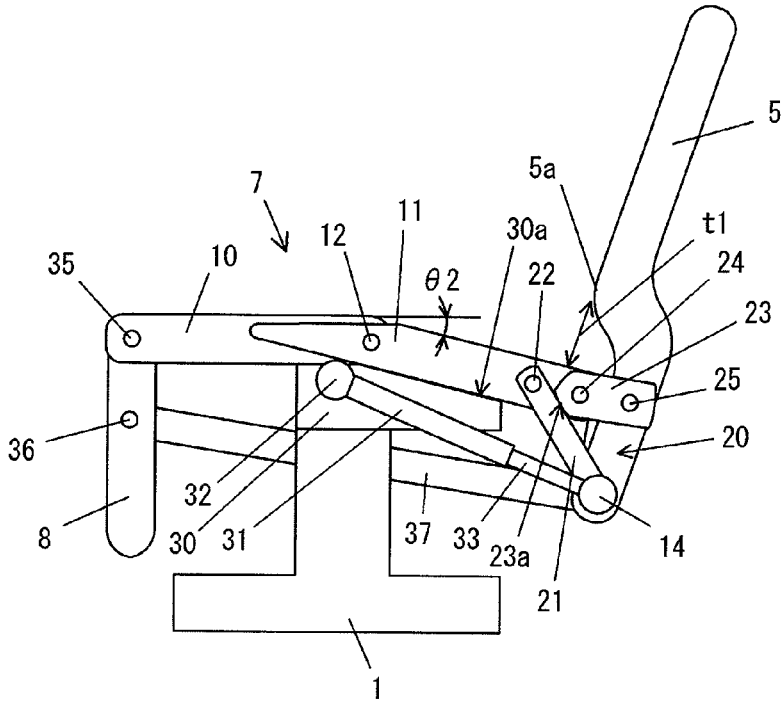
FIG. 4 is a side view of the chair (intermediate posture) in Embodiment 1 according to the present invention.
Figure 5:
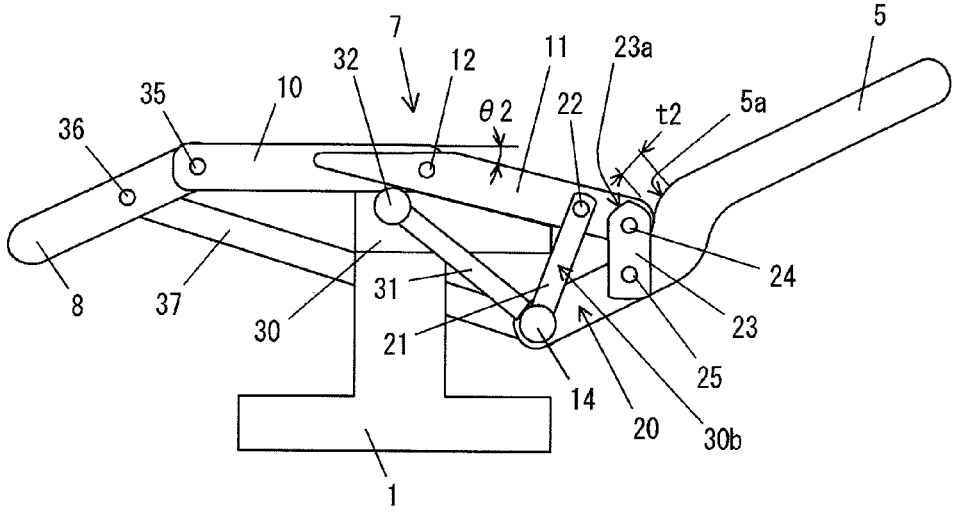
FIG. 5 is a side view of the chair (tilted posture) in Embodiment 1 according to the present invention.
Figure 6:
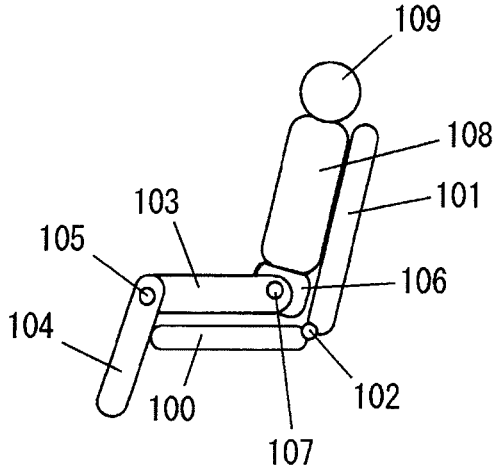
FIG. 6(*a*) is a side view of a conventional chair (standing posture)
Figure 6:
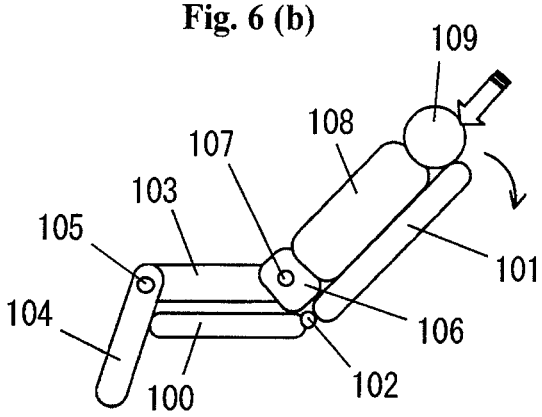
Figure 7:
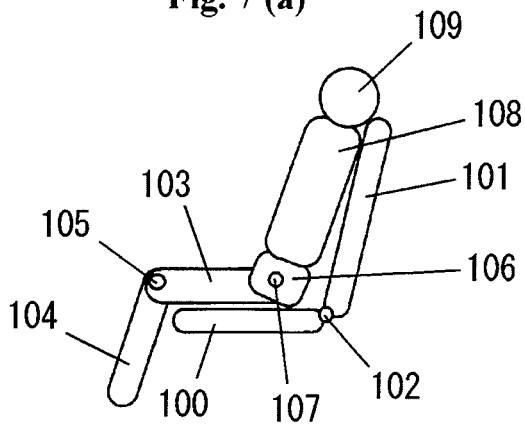
FIG. 7(*a*) is a side view of the conventional chair (standing posture)
Figure 7:
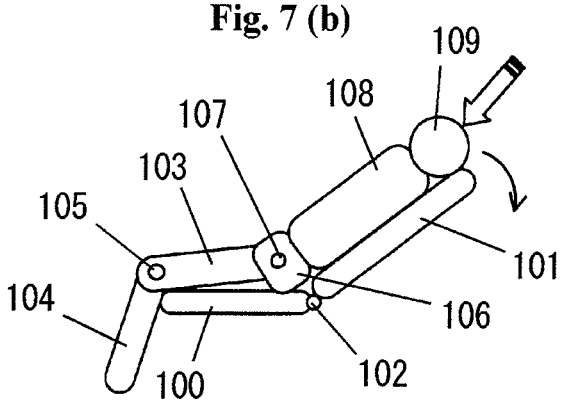
Figure 8:
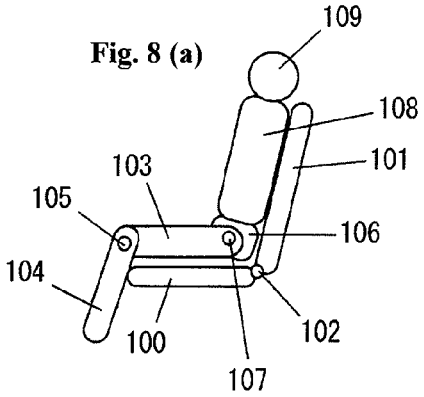
FIG. 8(*a*) is a side view of the conventional chair (standing posture)
Figure 8:
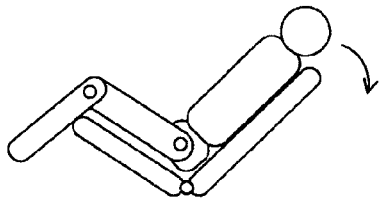
Figure 8:
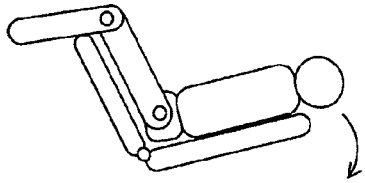
Figure 9:
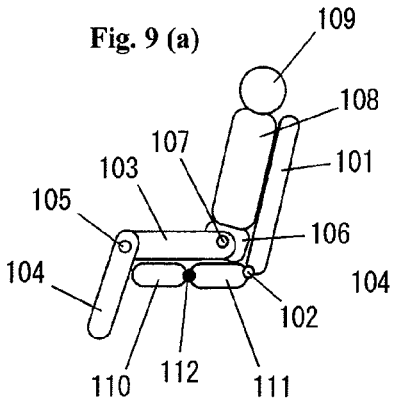
FIG. 9(*a*) is a side view of the conventional chair (standing posture)
Figure 9:
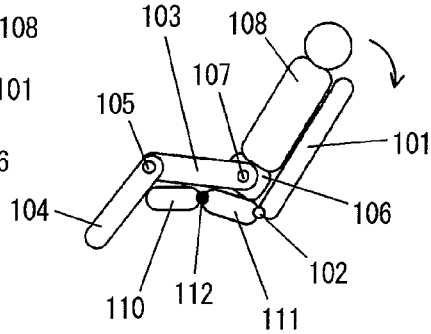
Figure 9:
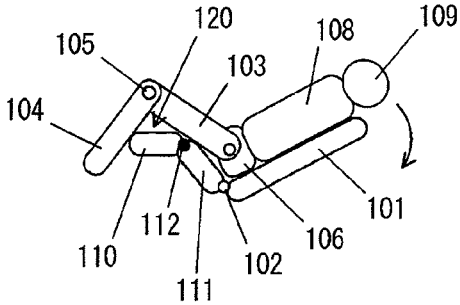

FIG. 3 shows the chair in a standing posture, FIG. 4 shows the chair in an intermediate posture, and FIG. 5 shows the chair a tilted posture, respectively.

As shown in FIG. 3, the seat 7 includes: a horizontal forward seat 10; and a backward (rearward) seat 11 continuously provided to the forward seat 10. The backward seat 11 is pivotally supported so as to be able to swing downward relative to the forward seat 10. The forward seat 10 is horizontally fixed so as not to move relative to the frame 1.

The rear end of the forward seat 10 and the front of the backward seat 11 are swingably connected with a hinge 12.

When the backrest 5 is in the standing posture shown in FIG. 3, the backward seat 11 is held so that the backward seat 11 is inclined downward having a small angle theta 1 relative to the forward seat 10. Preferably, the small angle theta 1 may be about from three degrees to five degrees.

When in the standing posture shown in FIG. 3, no force caused by the weight of the seated person and the service supplier thereof acts to the backrest 5 and the backward seat 11. At this time, a rod 33 of an air cylinder 31 is extended to the utmost. Needless to say, the air cylinder is a mere example, and elastic material such as a spring may be used instead.

A head end of the air cylinder 31 is swingably supported by a pivot part 32 relative to a baffle board 30 fixed on the frame 1, and a tail end of the rod 33 is swingably supported by a pivot part 14 to a lower end of the backrest 5.

Accordingly, the force of the air cylinder 31 acts, the distance between the pivot part 14 and the pivot part 32 is the maximum, the backward seat 11 is located most upward, and the backrest 5 is also raised most. The standing posture is defined as such a location.

A slanted plane having a normal direction extending obliquely upward is formed in front of the hinge 12 of the backward seat 11, and a tilting mechanism 20 is provided with a rear end of the backward seat 11.

The tilting mechanism 20 includes a first link 23, and a second link 21. In the example of FIG. 3, the second link 21 is formed so as to be longer than the first link 23.

Both ends of the first link 23 are swingably connected to the rear end of the backward seat 11 and to an intermediate position between the pivot part 14 located at the lower end of the backrest 5 and a waist support projecting part 5 *a* by the hinges 24 and 25, respectively. The reference point of the present Embodiment is the waist support projecting part 5 *a*. The reference point, however, may be another certain fixed point on the backrest 5 instead. Both ends of the second link 21 are swingably connected to a position located in front of the intermediate position of the backward seat 11 and the pivot part 14 located at the lower end of the backrest 5 by a hinge 22 and the pivot part 14, respectively.

When the chair is in the standing posture shown in FIG. 3, a front lower portion of an angle part 23*a* of the first link 23 contacts with a side face of the second link 21.

In response to the force caused by the air cylinder 31, the second link 21 pushes up the first link 23 so as to rotate it counterclockwisely in FIG. 3 about the hinge 22. The second link 21, however, keeps the position of FIG. 3 since the angle part 23*a* contacts with the side face of the second link 21. As a result, the backrest 5 also keeps the position of FIG. 3.

The baffle board 30 corresponds to a control unit, and possesses an inclined plane 30*a* that abuts on a side face of the backward seat 11 to control the angle of the backward seat 11.

In the standing posture of FIG. 3, the force of the air cylinder 31 causes the inclined plane 30*a* to separate from the side face of the backward seat 11, and the backward seat 11 can be further clockwisely rotated from the position of FIG. 3 about the hinge 12.

The upper ends of the leg supports 8 are swingably and pivotably supported to the front end of the forward seat 10 with a hinge 35. The pivot part 14 located at the lower end of the backrest 5 and a portion lower than the upper ends of the leg supports 8 are swingably connected to a connection link 37 with a hinge 36 and the pivot part 14. The connection link 35 corresponds to a connection mechanism.

Providing with such the connection link 35 enables the leg supports 8 to swing forward as shown in FIG. 4 to FIG. 5 as the backrest 5 is gradually inclined backward.

In the standing posture shown in FIG. 3, the backrest 5 is raised most, and the connection link 35 is pulled backward most. As a result, the leg supports 8 have inner positions (near the backrest 5) rather than vertical positions in the side view.

Accordingly, when a person is going to sit in the chair, the leg supports 8 do not interfere his/her lower thighs, and he/she can sit on the chair with ease. On the contrary, also when the seated person is going to stand up from the chair, the leg supports 8 do not interfere his/her lower thighs, and he/she can support his/her weight with ease. Such consideration becomes very important when the seated person is handicapped with respect to body operation.

The seated person sits on the chair in the standing posture shown in FIG. 3, and the backrest 5 is gradually inclined according to the weight of the seated person and/or nursing services by a service supplier. Then, until the intermediate posture shown in FIG. 4, the angle part 23*a* and the side face of the second link 21 are kept contacting with each other, and the backward seat 11, the tilting mechanism 20, the backrest 5, the connection link 37, and the leg supports 8 integrally swing about the hinge 12.

That is, until the baffle board 30 starts to control the angle of the backward seat 11, the distance from the waist support projecting part 5*a* to the backward seat 11 is kept to be a fixed distance t1 in the standing posture, and the backrest 5 and the backward seat 11 integrally swing.

In the intermediate posture shown in FIG. 4, the backward seat 11 and the inclined plane 30*a* of the baffle board 30 begin to abut on each other. Accordingly after that, the backward seat 11 cannot swing clockwisely in FIG. 4, thereby controlling the angle of the backward seat 11.

In addition, when the posture of the chair has changed from the standing posture of FIG. 3 to the intermediate posture of FIG. 4, the length that the rod 33 projects from the air cylinder 31 becomes slightly shorter, and the connection rod 37 moves slightly forward. As a result, the leg supports 8 are inclined almost perpendicularly or more forward, and the leg supports 8 push and support the lower thighs of the seated person in a slight forward direction.

As discussed above, after the intermediate posture of FIG. 4, the swing of the backward seat 11 is controlled so that the angle between the forward seat 10 and the backward seat 11 becomes the maximum angle theta 2. Preferably, the maximum angle theta 2 is about 30 degrees.

If the backrest 5 is further inclined from the intermediate posture of FIG. 4, the slip pointed out in the "background art" easily occurs. According to the present Embodiment as mentioned below, when the angle of the backward seat 11 is controlled, the distance from the waist support projecting part 5*a* to the backward seat 11 becomes smaller than the distance t1 in the standing posture, and the backrest 5 swings independently of the backward seat 11, wherein the backward seat 11 does not move.

As shown in FIG. 5, when the posture of the changes to the tilted posture, the rod 33 of the air cylinder 31 moves into the air cylinder 31, and the rod 33 of the air cylinder 31 does not project from the air cylinder 31 any more. This is, however, a mere example, and can be changed variously while included in the present invention.

When the backrest 5 is further inclined while the swing of the backward seat 11 is controlled, the second rod 21 and the angle part 23*a* of and the first rod 23 separate with each other to open these rods 21 and 23.

As a result, the backrest 5 draws a locus of diving down, and the above-mentioned distance becomes smaller (the distance t2<the distance t1. That is, the waist support projecting part 5*a* follows the movement of the waist of the seated person, thereby avoiding the slip.

Since the connection rod 37 is pushed forward as the lower end of the backrest 5 moves lower forward, the leg supports 8 move obliquely upward. As a result, as shown in FIG. 5, as the chair is fully reclined, the lower legs of the seated person are pushed up naturally, the seated person feels no burden of his/her waist and can take the tilted posture and the lying posture at ease.

On the contrary, when the backrest 5 is raised up from the tilted posture shown in FIG. 5, the posture of the chair is changed to the standing posture of FIG. 3 through the intermediate posture of FIG. 4. During the change of the posture, there is no unpleasant slip, and the seated person can stand up from the chair in the standing posture.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

DESCRIPTION OF SYMBOLS

1: Frame
2: Truckle
3: Wheel
4: Armrest
5: Backrest
5*a*: Waist support projecting part
6: Pillow
7: Seat
8: Leg Support
8*a*: Side Support
9: Footrest
10: Forward Seat
11: Backward Seat
12, 22, 24, 25, 35, and 36: Hinge
14 and 32: Pivot Part
20: Tilting Mechanism
21: Second Link
23: First Link
23*a*: Angle
30: Baffle Board
30*a*: Inclined Plane
30*b*: Angle Part
31: Air Cylinder
33: Rod
37: Connection Link

The invention claimed is:

1. A chair, comprising:

a backrest having a reference point and a lower end;

a seat which includes a forward seat having a front end and a rear end, said forward seat being fixed in a horizontal position, and a rearward seat pivotally connected to said forward seat, said rearward seat being capable of swinging downward relative to said forward seat, said rearward seat having a rear end;

a leg support having an upper end, said upper end of said leg support being pivotally supported to said front end of said forward seat;

a tilting mechanism for connecting said rear end of said rearward seat and said lower end of said backrest so that said backrest is tiltable in a backward direction from a standing posture to a tilted posture, said tilting mechanism changing a positional relation between said rear end of said rearward seat and said lower end of said backrest so that a distance between the reference point and said rearward seat is reduced from the standing posture to the tilted posture as said backrest is tilted backward; and a connection mechanism for connecting said lower end of said backrest and a part of said leg support lower than said upper end of said leg support so as to cause said leg support to swing forward as said backrest is tilted backward, wherein said tilting mechanism comprises:

a first link possessing a first end fastened by a hinge to said rear end of said rearward seat, and a second end fastened by a hinge to a middle position between said lower end of said backrest and the reference point, respectively; and a second link formed longer than said first link, said second link possessing a third end fastened by a hinge to a position of said rearward seat in front of the middle position, and a fourth end fastened by a hinge to said lower end of said backrest, respectively.

2. The chair as defined in claim 1, further comprising a control unit for controlling an angle between said forward seat and said rearward seat, wherein, while the angle is not controlled by said control unit, said tilting mechanism connects said rear end of said rearward seat and said lower end of said backrest so as to keep the distance between the reference point and said rearward seat the same as the distance between the reference point and said rearward seat in the standing posture so that said backrest and said rearward seat swing integrally, and wherein, when the angle is controlled by said control unit, said tilting mechanism connects said rear end of said rearward seat and said lower end of said backrest so as to reduce the distance between the reference point and said rearward seat from the distance between the reference point and said rearward seat in the standing posture so that said backrest swings independently from said rearward seat.

3. The chair as defined in claim 2, wherein said control unit comprises a baffle board having an inclined plane in contact with a side face of said rearward seat to control the angle.

4. The chair as defined in claim 1, wherein a side support for a leg is added to a side of said leg support.

5. The chair as defined in claim 1, wherein said rearward seat is kept such that said rearward seat is tilted downward at a small angle relative to said forward seat when said backrest is in the standing posture.

* * * * *